US006517452B2

(12) United States Patent
Endres

(10) Patent No.: US 6,517,452 B2
(45) Date of Patent: Feb. 11, 2003

(54) BASEBALL TRAINING APPARATUS

(76) Inventor: Wilhelm Endres, Falkensteinweg 12, 87549 Rettenberg (DE)

( * ) Notice: Subject to any disclaimer, the term of this patent is extended or adjusted under 35 U.S.C. 154(b) by 0 days.

(21) Appl. No.: 09/902,409

(22) Filed: Jul. 10, 2001

(65) Prior Publication Data

US 2003/0013562 A1 Jan. 16, 2003

(51) Int. Cl.[7] ..... A63B 69/00
(52) U.S. Cl. ..... 473/454
(58) Field of Search ..... 473/422, 451, 473/459, 460, 432

(56) References Cited

U.S. PATENT DOCUMENTS 4,784,107 A * 11/1988 Kelly ..... 124/61
5,417,196 A * 5/1995 Morrison et al. ..... 124/6
5,566,934 A * 10/1996 Black et al. ..... 473/431

* cited by examiner

*Primary Examiner*—Paul T. Sewell
*Assistant Examiner*—M. Chambers
(74) *Attorney, Agent, or Firm*—Michael J. Striker

(57) ABSTRACT

A device for training a baseball pitcher has a baseball catching element operative for catching a baseball, a baseball throwing element operating for throwing a caught baseball in accordance with a catapult principle, and a drive connecting with the baseball throwing element and actuating the baseball throwing element when the baseball is received by the baseball throwing element.

3 Claims, 8 Drawing Sheets

BASEBALL TRAINING APPARATUS

BACKGROUND OF THE INVENTION

The present invention relates to a baseball training apparatus.

More particularly, it relates to an apparatus which provides assistance to a baseball pitcher, or in other words a training device for a pitcher in a baseball game.

Conventionally, a rubber-coated net arranged in a frame is utilized for training of pitchers. The baseball is caught by a pitcher in this rubber-coated net, thereby the net is tensioned and the baseball is thrown back. The known device has certain problems with regard to the accuracy of the throwing back of the baseball.

SUMMARY OF THE INVENTION

Accordingly, it is an object of the present invention to provide baseball training apparatus which avoids the disadvantages of the prior art.

More particularly it is an object of present invention to provide baseball training apparatus, which makes possible a precise guiding back of the baseball after the throw to the pitcher.

It is another feature of the present invention to provide a device of the above mentioned type, in which the energy supply is self-sufficient.

Also, it is another object of the present invention to provide a device of the above mentioned general type, which is independent from weather and does not cause resulting costs.

In keeping with these objects and with others which will become apparent hereinafter, one feature of present invention resides, briefly stated, in a device for training a baseball pitcher, which has a catching element formed to catch a baseball; a throwing element to which the baseball is directed after it was caught by the catching element; and a drive operative for displacing said throwing element so that said throwing element throws the baseball back to a pitcher, said throwing element being activated for throwing the baseball in response to the baseball falling on said throwing element.

In accordance with the present invention the catching element can be formed as a net arranged on a frame, the throwing element can be formed as a catapult etc, and the drive can be formed as a pressurized air drive, a solar energy drive, a magnetic drive, etc.

When the device is designed in accordance with the present invention, it eliminates the disadvantages of the prior art and provides for the above mentioned highly advantageous results.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
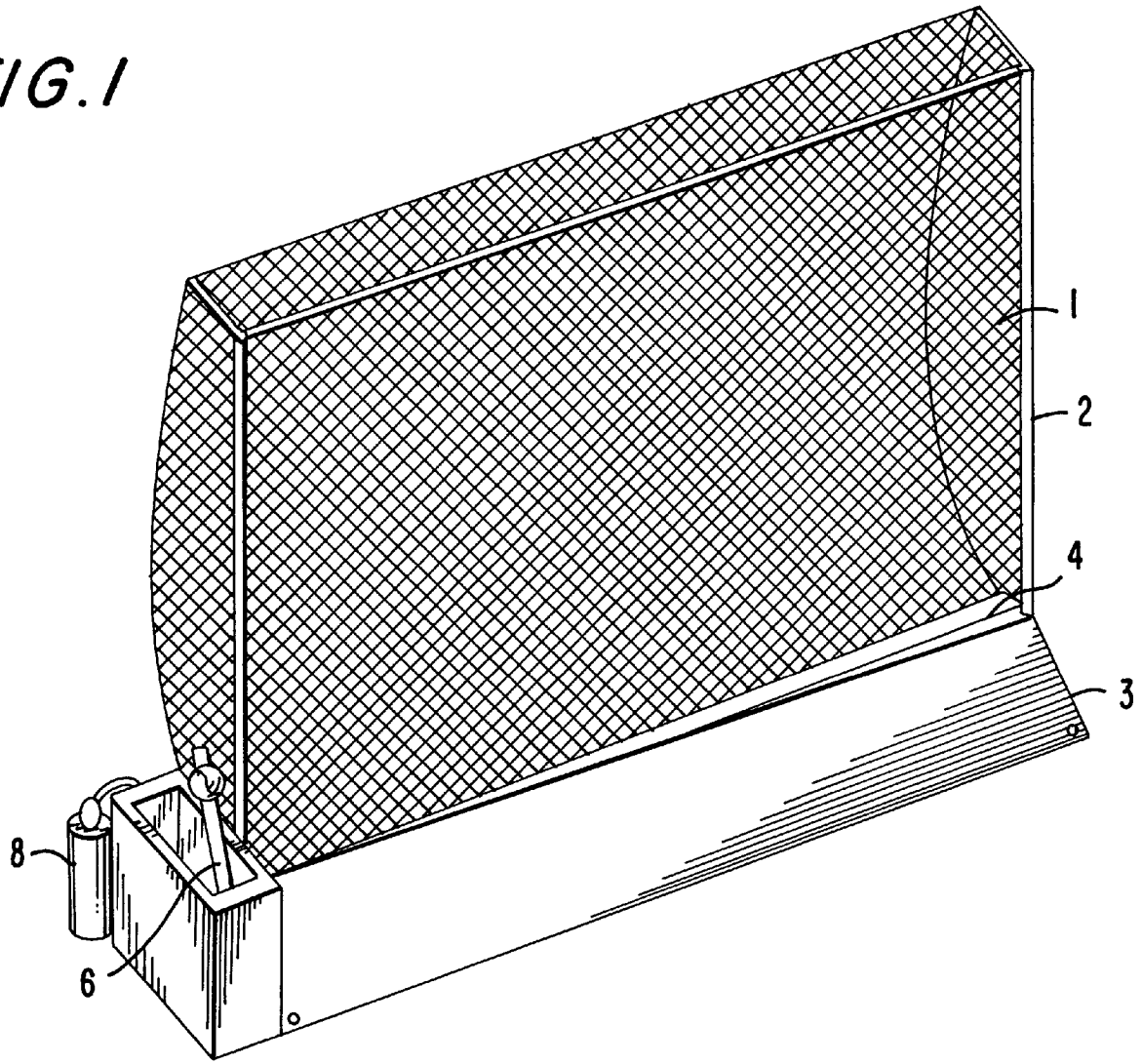
FIG. 1 is a perspective view of a new device for training a baseball pitcher.
Figure 2:
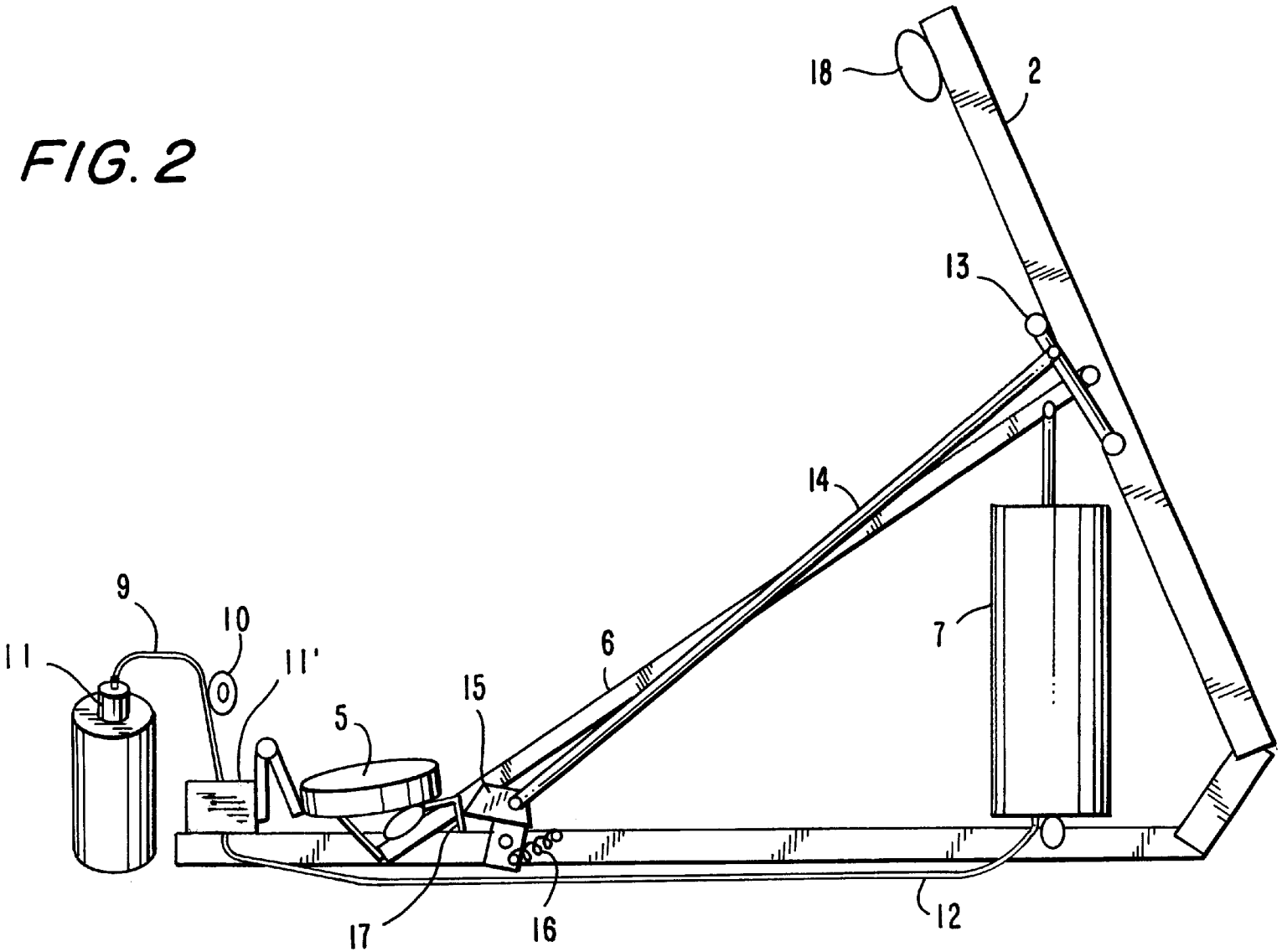
FIG. 2 is a schematic side view of the device for training a baseball pitcher.
Figure 3:
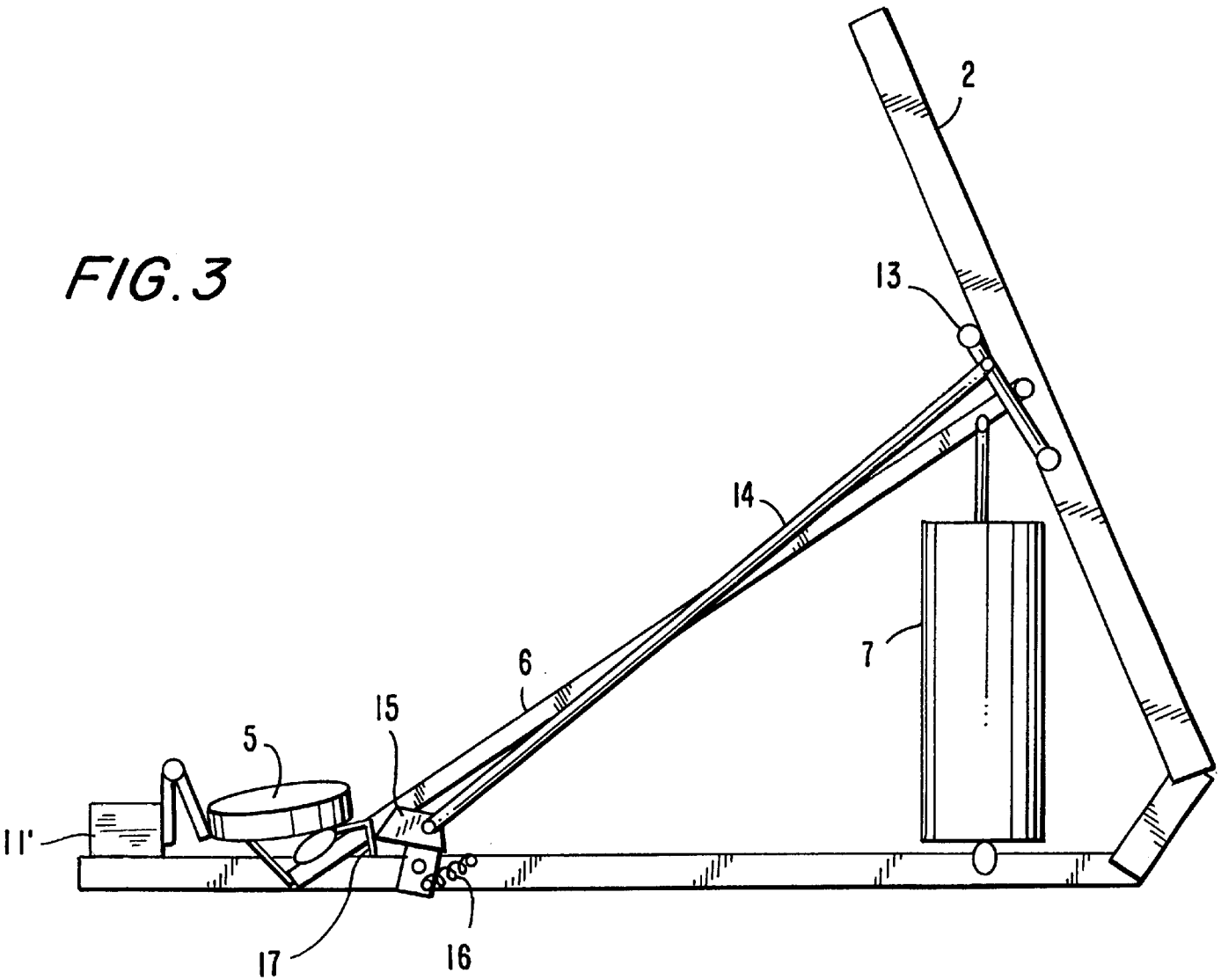
FIG. 3 is a view showing the inventive device for training a baseball pitcher in an initial position before a baseball hits the device.

A device for training a baseball pitcher in accordance with the present invention has a catching unit which can be formed as a net 1 mounted on a frame 2. An inclined protective plate 3 is associated with the lower part of the frame and forms a rolling trough 4.

The device also has a throwing unit for throwing a baseball. The throwing unit includes a catching plate 5 and a throwing arm 6 having one end associated with the catching plate 5 and another end pivotably connected to the frame 2.

The device further has a drive for displacing the throwing arm 6 so as to throw a baseball received on the catching plate 5. The drive in the shown embodiment is formed as a pneumatic cylinder-piston unit 7 which has an immovable cylinder, and a piston which is reciprocatingly movable in the cylinder and connected to the opposite end of the throwing arm 6.

The cylinder-piston unit 7 is supplied with pressurized air from a pressure container 8 through a pressure conduit 9 provided with a pressure regulating valve 10 and then through a 3/2 directional valve 11' and a further pressure conduit 12.

A contact pin 13 is further provided and connected through a rod 14 with a locking hook 15 which is spring biased by a pulling spring 16.

The device for training a baseball pitcher in accordance with the present invention operates in the following manner.

In the initial position shown in FIG. 1 before hitting the ball, the catching plate 5 is connected with the valve 11' and located in its initial position. An arresting angle 17 located at the right side of the catching plate 5 is not locked with the locking hook 15. The throwing arm 6 is located with its one end under the catching plate 5 in the initial position. The throwing arm 6 is connected with the pressurized air cylinder-piston unit and pivotably connected with the frame 2 at the opposite end.

Figure 4:
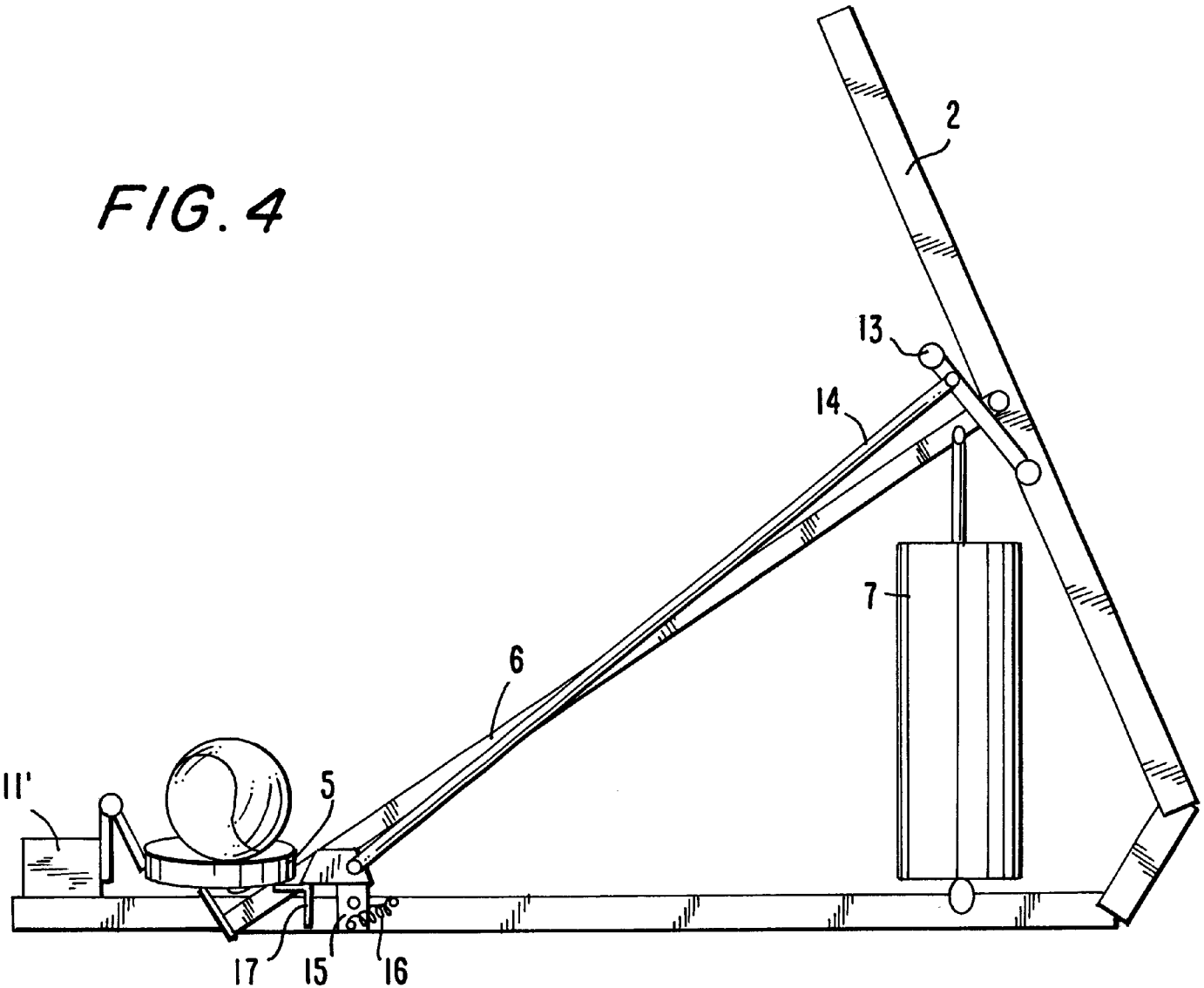
FIG. 4 is a side view of the device in accordance with the present invention in the position when a baseball hits the device.

When the ball hits the net 1, it rolls through the rolling trough 4 downwardly and falls onto the catching plate 5. This situation is shown in FIG. 4. The catching plate 5 has such a weight that the weight of the ball is sufficient to displace it downwardly. Thereby the arresting angle 17 is locked by the locking hook 15. The valve 11' is open under the action of lowering of the catching plate 5 and the pressurized air flows into the cylinder-piston unit. The throwing arm 6 is accelerated upwardly through a slot in the catching plate 5 and drives the baseball with it. During the whole accelerating movement the valve 11' remains open, since the catching plate 5 is always locked in its lower position.

Figure 5:
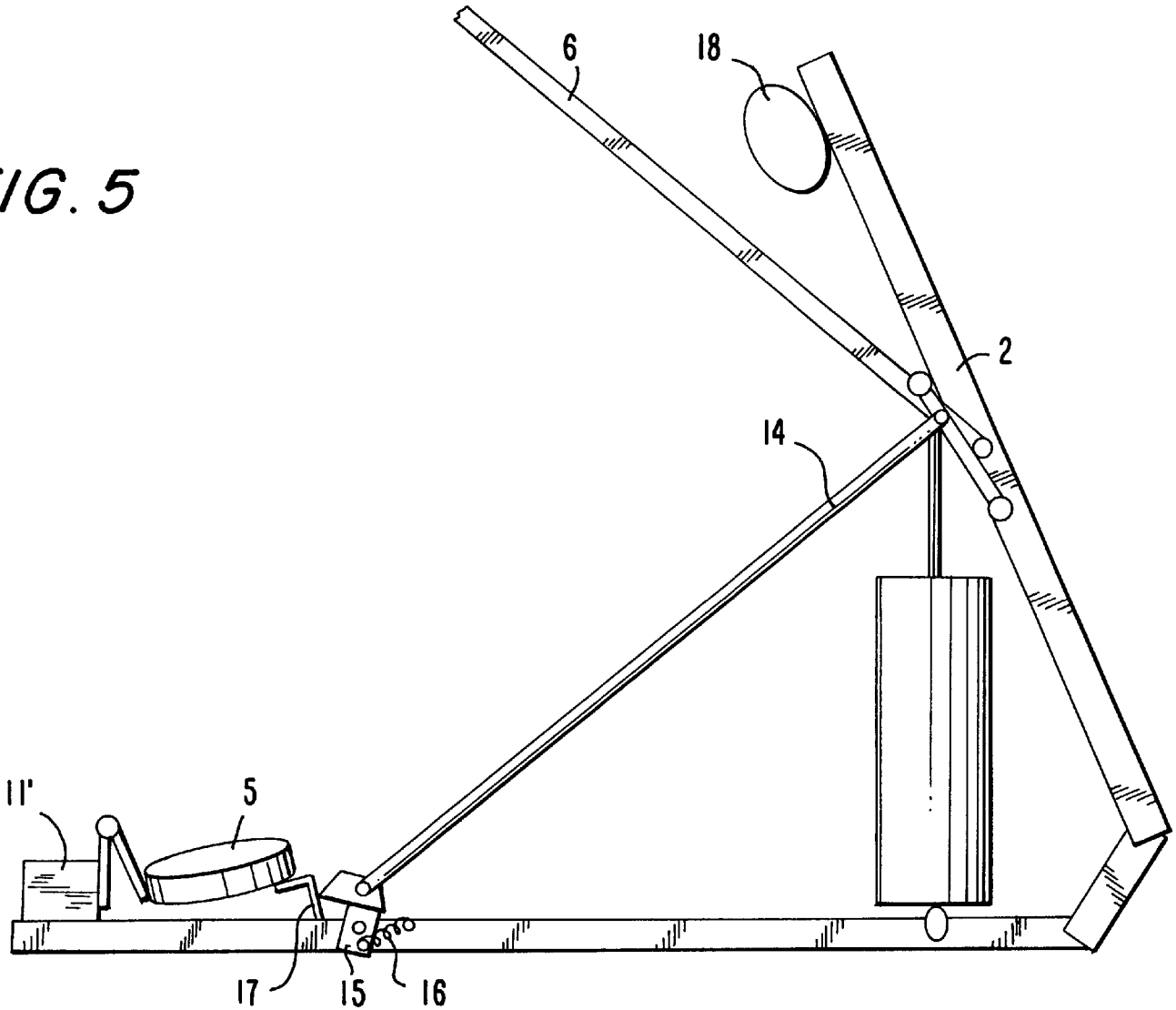
FIG. 5 is a view showing the inventive device in the position in which a throwing element is activated and throws the baseball.
Figure 6:
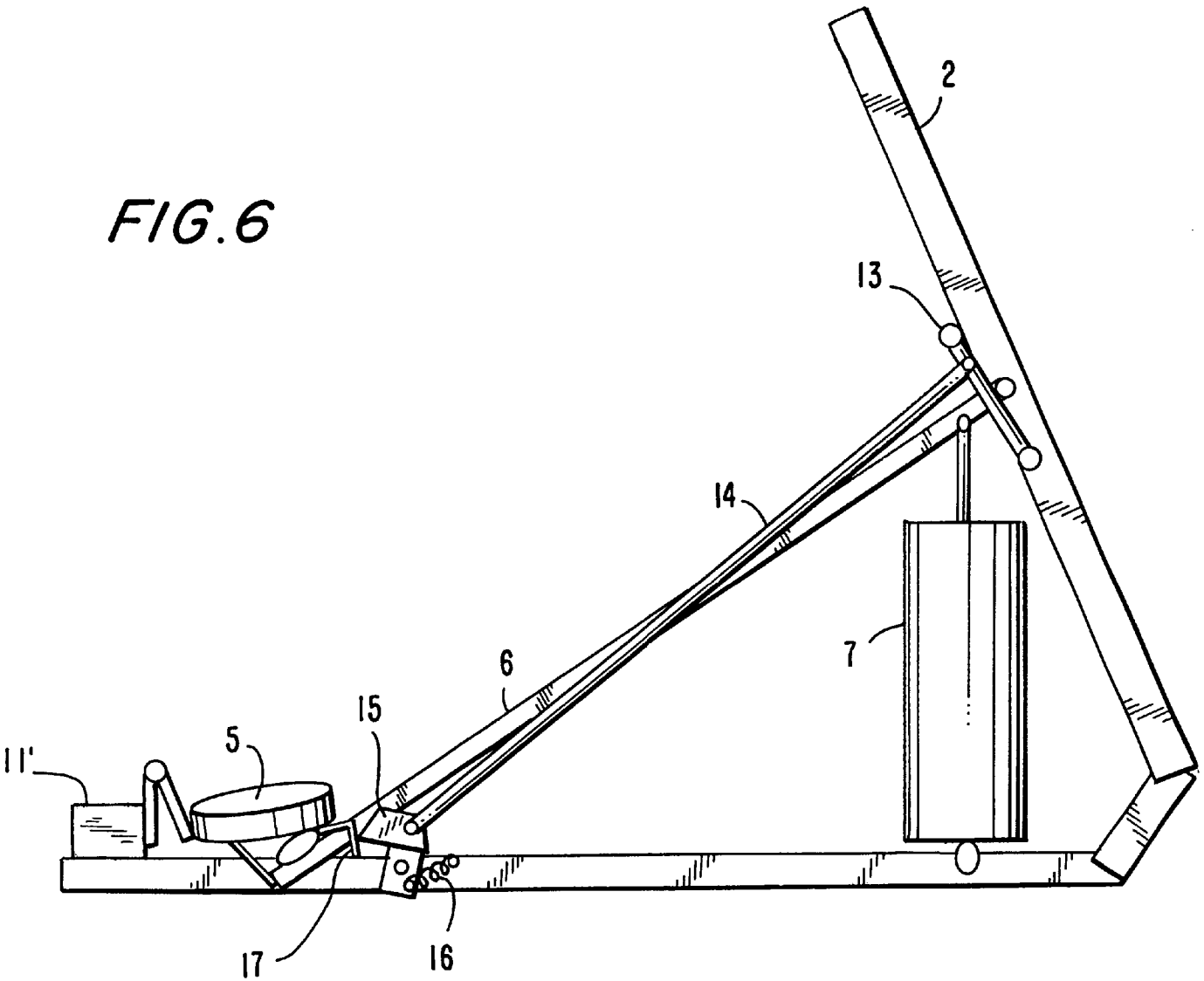
FIG. 6 is a view showing the inventive device in the position in which the throwing element is returned to its initial position.

As can be seen from FIG. 5, the accelerating movement or throwing movement is performed so far, that the throwing arm 6 hits the contact pin 13 and displaces until it hits a rubber coating 18. The contact pin 13 is connected through the rod 14 with the locking hook 15. By the movement of the contact pin 13, the catching plate 5 is unlocked. The catching plate can now move upwardly, so that the valve 11' is closed and the pressurized air supply is interrupted. Simultaneously, a connection between atmosphere and the cylinder-piston unit is established through the valve 11', so that air escape from the cylinder-piston unit. Thereby the throwing arm 6 moves back to the initial position shown in FIG. 6. Without the locking mechanism the pressurized air supply to the cylinder-piston unit 7 would be interrupted when the throwing arm 6 lifts the baseball substantially from the catching plate 5. By lifting of the baseball the catching plate 5 is unloaded and the valve 11' would be closed.

FIG. 6 again shows the initial situation. The throwing arm 6 falls back after the throw, to its initial position. The catching plate 5 is not locked, since no ball is located on it. The operational pressure amounts approximately to 5.5 bar and can be regulated by the pressure regulator 10 located between the pressure container 8 and the valve 11'. The catching plate 5 is connected with the displacement valve 11' through a connecting hinge 21.

Figure 7:
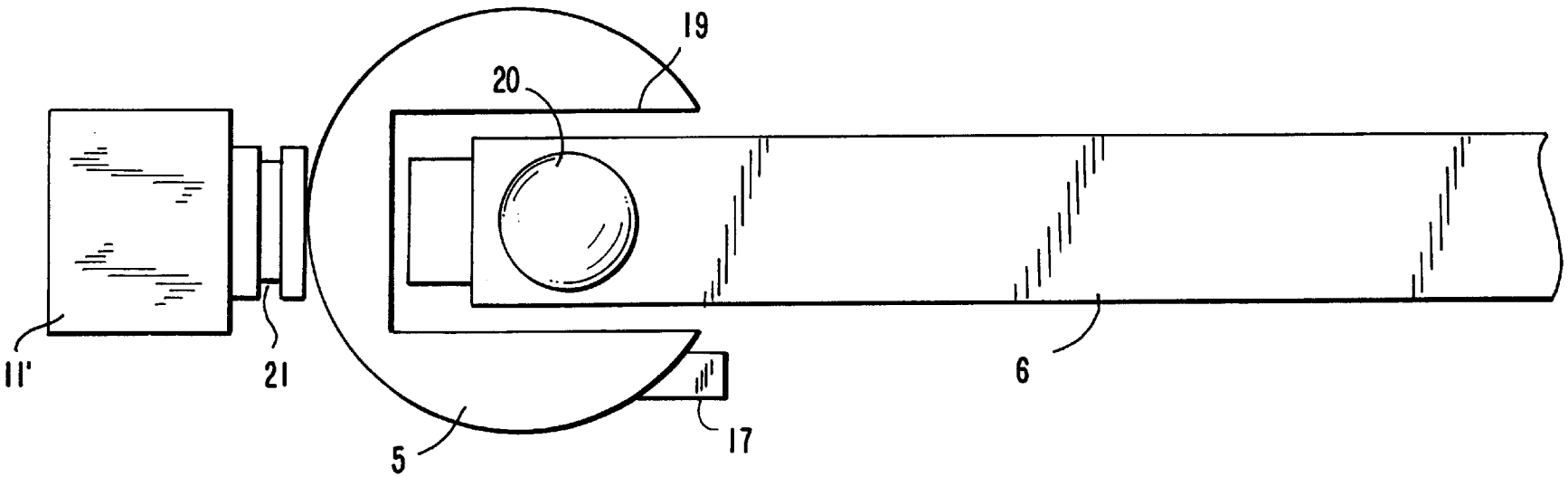
FIG. 7 is a plan view of a portion of the inventive device.

FIG. 7 shows the catching plate 5 with the groove 19 on a plan view. Ball guides 20 also provided to guarantee that after hitting the catching plate 5 the ball reaches an optimal throwing position.

Figure 8:
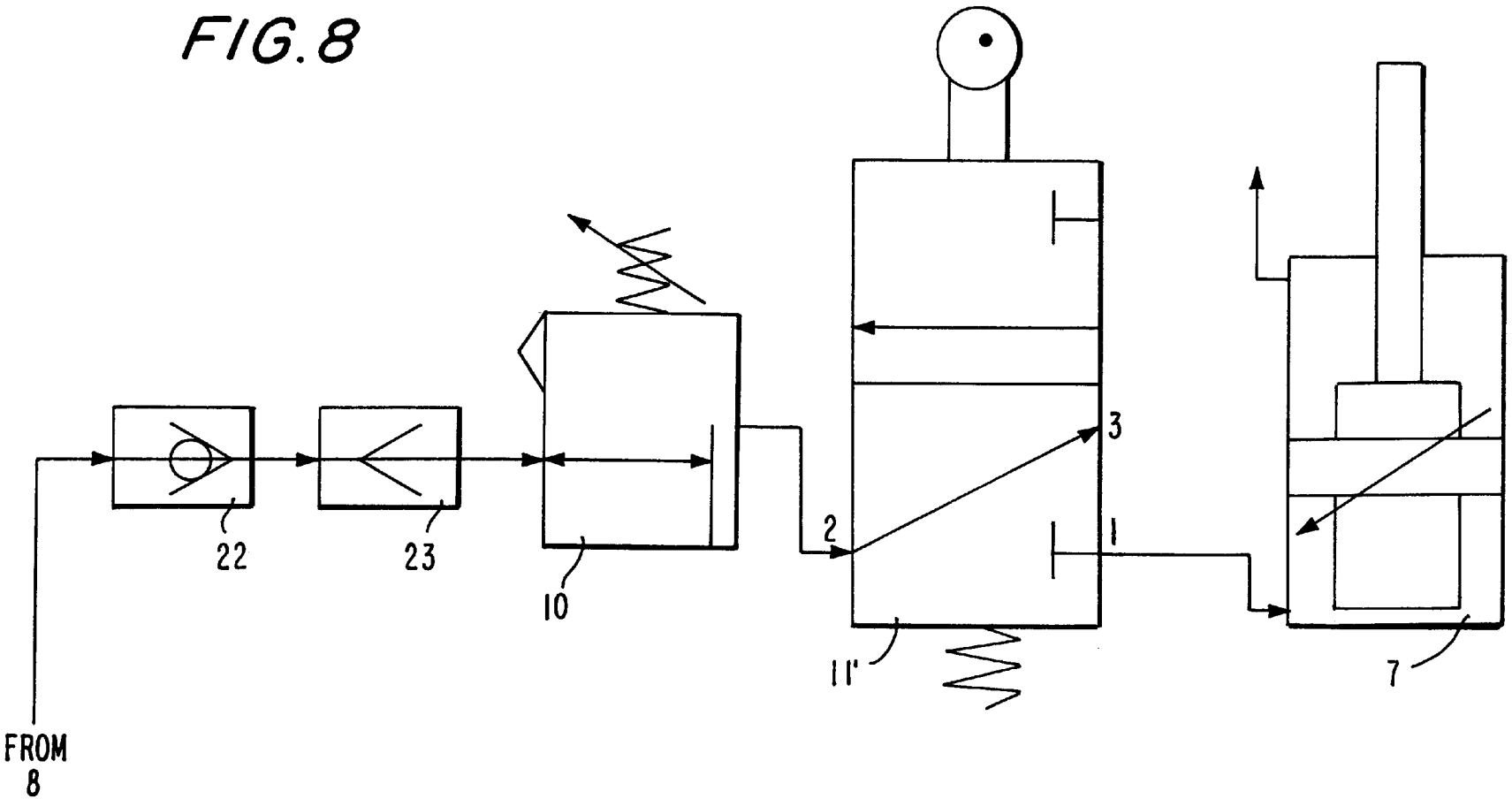
FIG. 8 is a view showing a diagram of a pneumatic system of the inventive device.

FIG. 8 shows a switching diagram of the 3/2 valve 11'. During the accelerating or throwing movement, the connection between the pressure container 8 and the pressurized air cylinder-piston unit 7 is established. During the downward movement of the throwing arm 6 after the throw, the pressurized air cylinder-piston unit 7 is connected with atmosphere through the 3/2 directional valve 11'. This figure shows a connection of the pressure container 8 with the pressurized air cylinder-piston unit 7 through a fast coupling 22, a plug nipple 23, the pressure regulator 10, and the displacement valve 11'.

It will be understood that each of the elements described above, or two or more together, may also find a useful application in other types of constructions differing from the types described above.

While the invention has been illustrated and described as embodied in baseball training apparatus, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A device for training a baseball pitcher, comprising baseball catching means operative for catching a baseball; baseball throwing means operating for throwing a caught baseball; and drive means connecting with said baseball throwing means and driving said baseball throwing means when the baseball is received by said baseball throwing means; and valve means connected with said drive means and with said receiving plate so that when said receiving plate is moved under the action of the baseball, said valve means is activated and allows a supply a working medium from a source of the working medium to said drive means to activate said drive means and thereby to displace said throwing arm.

2. A device as defined in claim 1, wherein said catching plate is formed so that when it moves to its initial position it closes said valve.

3. A device for training a baseball pitcher, comprising baseball catching means operative for catching a baseball; baseball throwing means operating for throwing a caught baseball; and drive means connecting with said baseball throwing means and driving said baseball throwing means when the baseball is received by said baseball throwing means, said receiving means including a receiving plate, said throwing means include a throwing arm connected with said drive means and retained in an absence of a baseball, said receiving means being movable under an action of a weight of the baseball so as to release said throwing arm, whereupon said drive turns said throwing arm so that said throwing arm takes the baseball from said receiving plate and throws it; a locking element for locking and unlocking said receiving plate; a contact pin actuatable by said throwing arm; and a rod connecting said contact pin with said locking element, so that when said throwing arm contacts said contact pin at an end of throwing movement, said locking element releases said receiving plate and said receiving plate is moved to its initial position.

* * * * *